United States Patent [19]

Gutridge et al.

[11] 4,183,179

[45] Jan. 15, 1980

[54] SLIDING DOOR AND DOOR GUIDE ARRANGEMENT FOR A RAILWAY PASSENGER CAR COMPARTMENT

[75] Inventors: Jack E. Gutridge, Dyer; Roy W. Miller, Highland; Walter J. Marulic, Gary, all of Ind.

[73] Assignee: Pullman Incorporated, Chicago, Ill.

[21] Appl. No.: 902,511

[22] Filed: May 3, 1978

[51] Int. Cl.[2] ..... E05D 13/02

[52] U.S. Cl. ..... 49/411; 16/93 R; 16/85

[58] Field of Search ..... 49/409–411; 16/85, 93 R

[56] References Cited

U.S. PATENT DOCUMENTS

| | | | |
|---|---|---|---|
| 1,194,991 | 8/1916 | Gervais | 16/85 |
| 3,562,956 | 2/1971 | Johnson, Jr. | 49/411 |
| 4,090,265 | 5/1978 | Baus | 49/410 |

*Primary Examiner*—Kenneth Downey
*Attorney, Agent, or Firm*—Richard J. Myers

[57] ABSTRACT

A sliding door and door guide arrangement for the door opening of a railway passenger compartment including a spring biased door guide mechanism for retarding abrupt movement of the door due to car impacts during rail operations and including a threshold plate having a guide channel cooperative with a guide plate depending from the door slidingly engaged therein to align the door and downwardly biased thereagainst to retard abrupt movements of the door.

10 Claims, 8 Drawing Figures

SLIDING DOOR AND DOOR GUIDE ARRANGEMENT FOR A RAILWAY PASSENGER CAR COMPARTMENT

CROSS-REFERENCE TO RELATED PATENT APPLICATIONS

U.S. Ser. No. 861,920 filed Dec. 19, 1977, now U.S. Pat. No. 4,134,233

U.S. Ser. No. 896,943 filed Apr. 17, 1978

BACKGROUND OF THE INVENTION

1. Field of the Invention

The present invention relates to sliding doors and more particularly to a sliding door and door guide arrangement for a railway passenger car compartment.

2. Description of the Prior Art

The prior art includes U.S. Pat. Nos. 2,078,811 and 2,744,301 which pertain to door guide rail and roller arrangements for sliding doors. The present invention is an improvement over these designs.

SUMMARY OF THE INVENTION

The present invention relates to a sliding door and door guide arrangement for a railway passenger car compartment. The construction includes a sliding door having a pair of laterally spaced tubular end members having opposing vertical recesses and a door panel secured thereto extending into the recesses and between the end members. The door guide arrangement includes a self-cleaning threshold plate spaced beneath the door to enhance ventilation within the compartment extending the width of the door opening and including a guide channel having dished-out and cleaning portions. A door guide plate cooperative with the threshold plate depends from a plate housing secured within the tubular end member adjacent the nose of the door and is slidably engaged within the channel and downwardly biased thereagainst to transversely align the door and secure it against abrupt movement due to car impacts during rail operations as well as scrub out the channel to facilitate self-cleaning of the door guide arrangement.

DESCRIPTION OF THE PREFERRED EMBODIMENT

Figure 1:
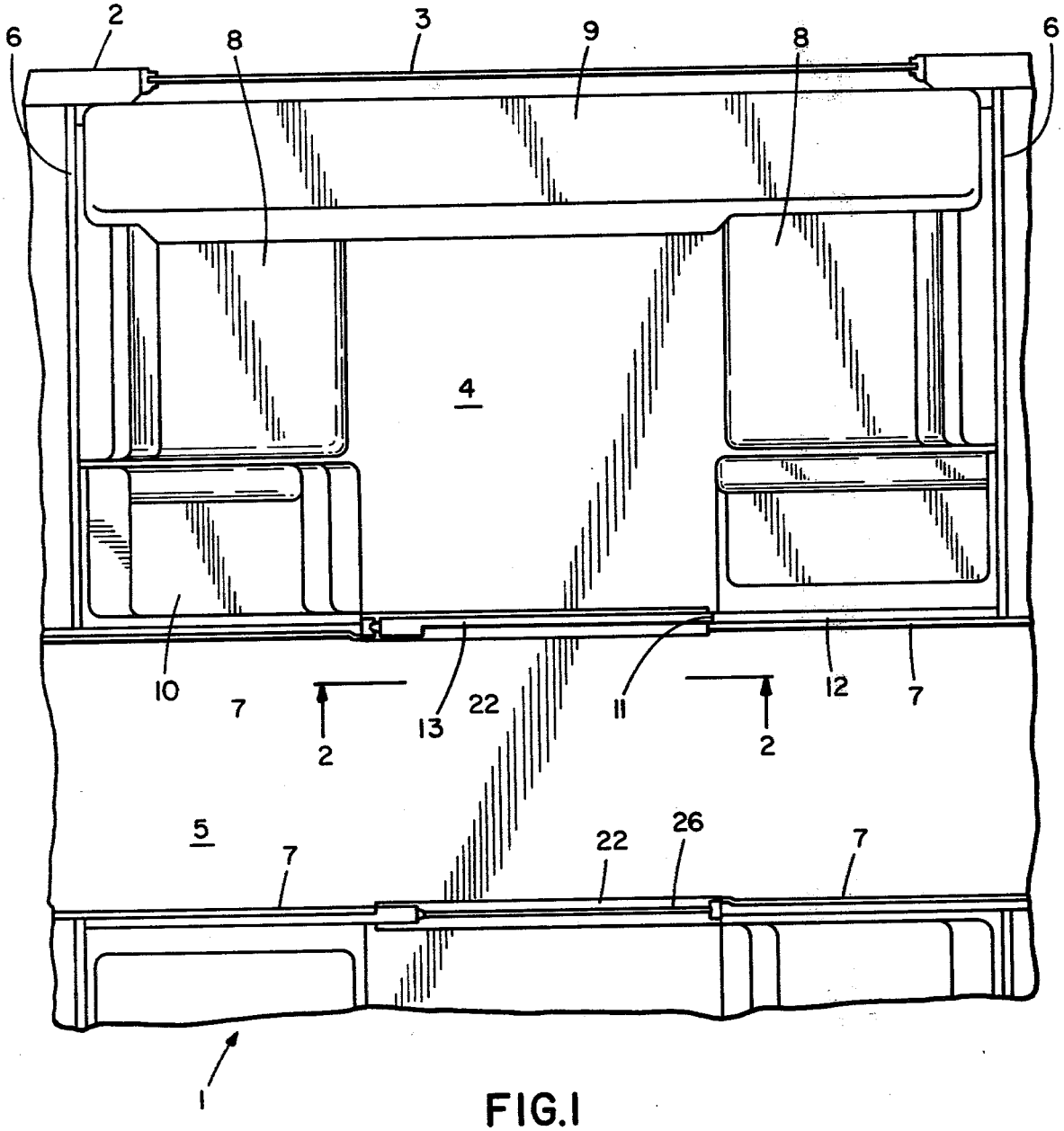
FIG. 1 is a schematic plan view of a sleeping car compartment embodying the novel door arrangement of the present invention.

Referring now to FIG. 1, a railway passenger car compartment 1 includes a car side 2, a side window 3, and a floor structure 4. As shown in FIG. 1, the compartments are positioned on the opposite sides of an aisle 5 and each includes transversely extending partition walls 6 suitably connected to longitudinally extending divider walls 7. The compartment 1 includes convertible seats 8, an upper berth 9, and combination units of an arm rest, ladder and storage compartment 10. The divider walls 7 are spaced longitudinally to provide a doorway or access opening 11. One of the combination units 10 is suitably spaced from one of the divider walls 7 to provide a storage space or recess designated at 12 which is used when the door 13 is moved to allow passage through the access opening 11.

Figure 4:
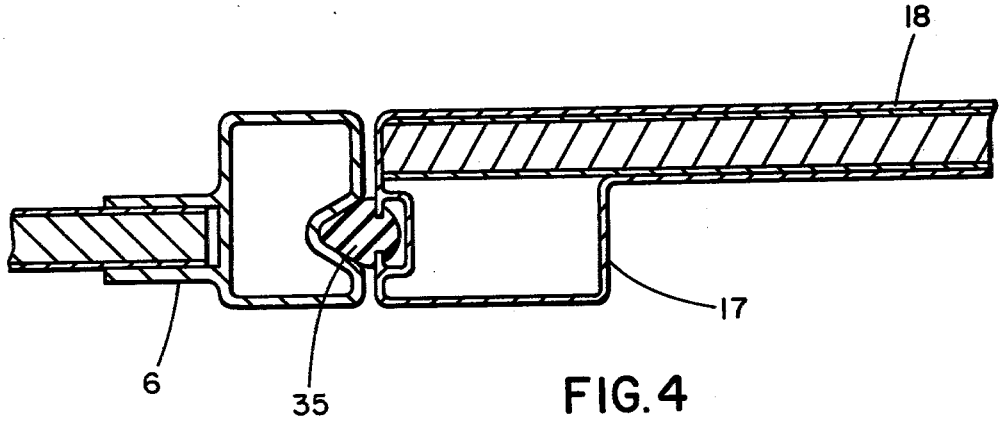
FIG. 4 is an enlarged cross-sectional view taken generally along line 4—4 in FIG. 2.
Figure 2:
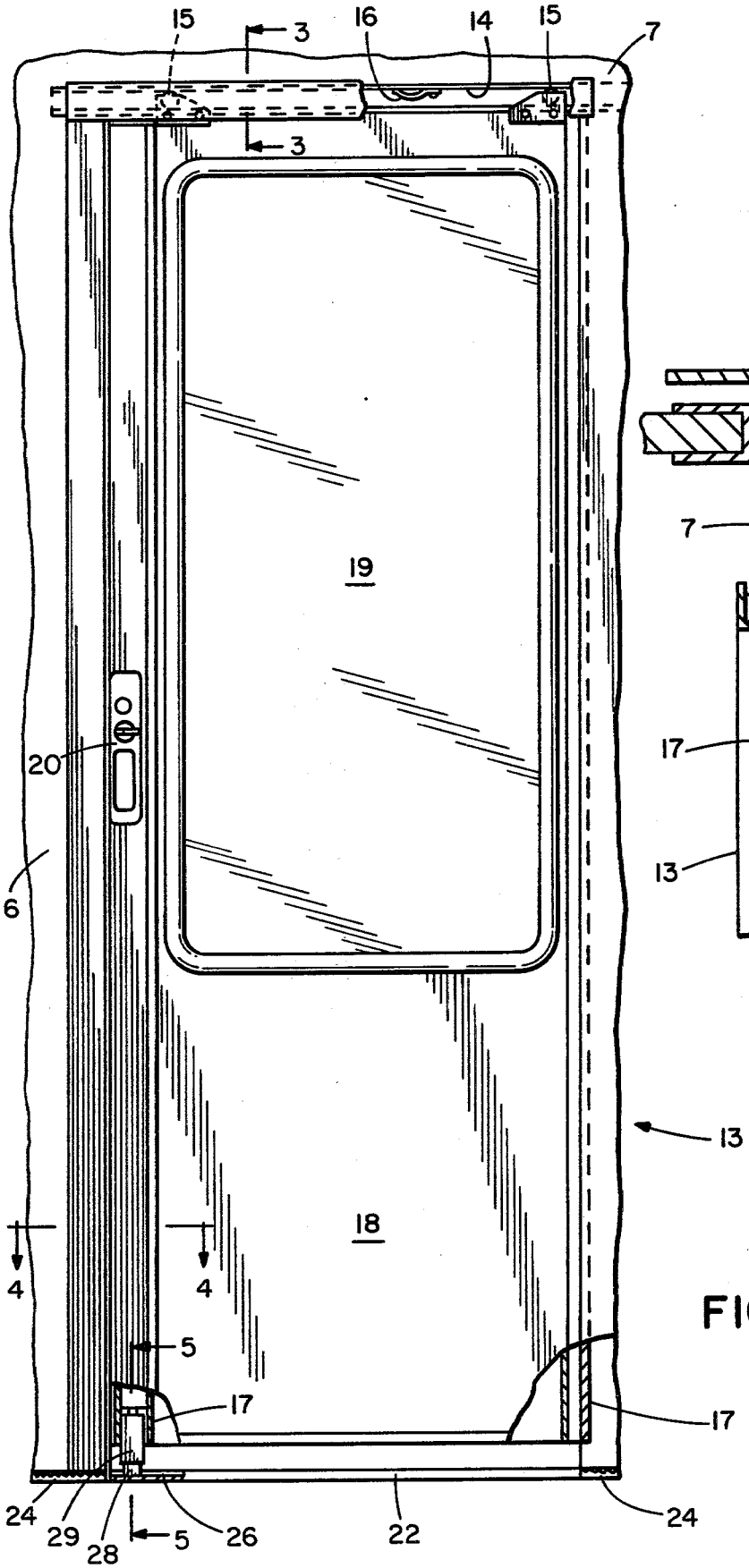
FIG. 2 is an elevational view taken generally along line 2—2 in FIG. 1.
Figure 3:
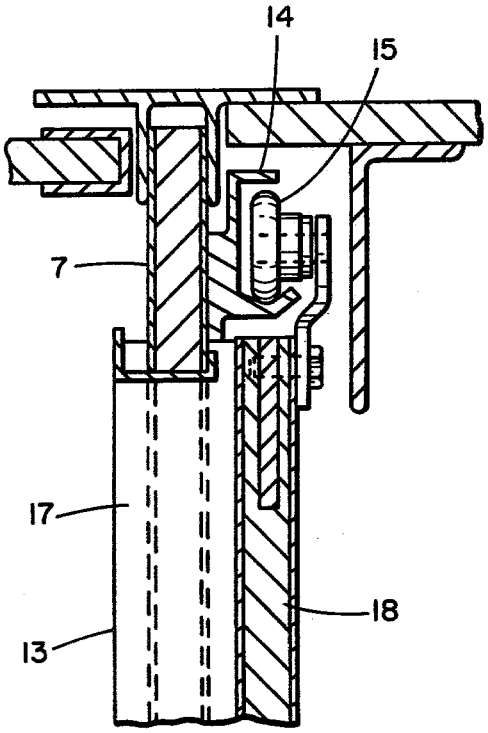
FIG. 3 is an enlarged cross-sectional view taken generally along line 3—3 in FIG. 2.
Figure 5:
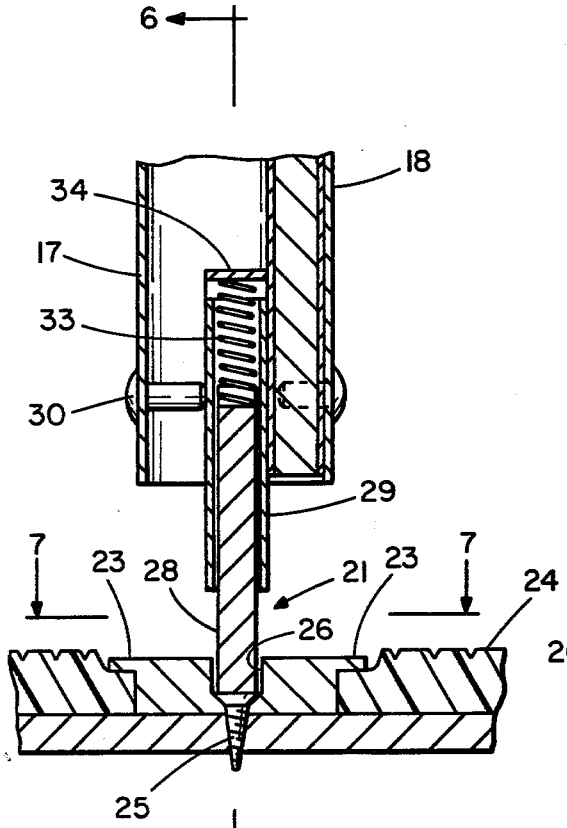
FIG. 5 is an enlarged fragmentary side elevational view partially in section showing the door guide and threshold arrangement.
Figure 6:
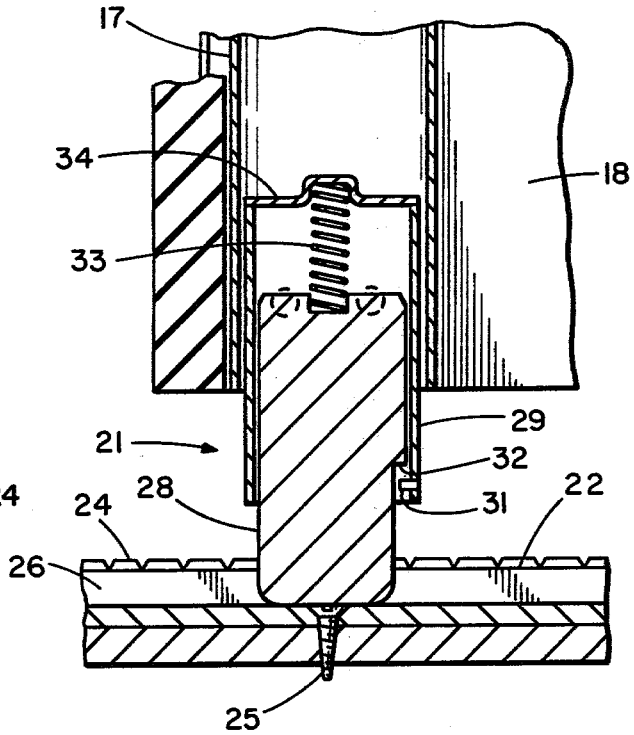
FIG. 6 is a cross-sectional view taken generally along line 6—6 in FIG. 5.
Figure 7:
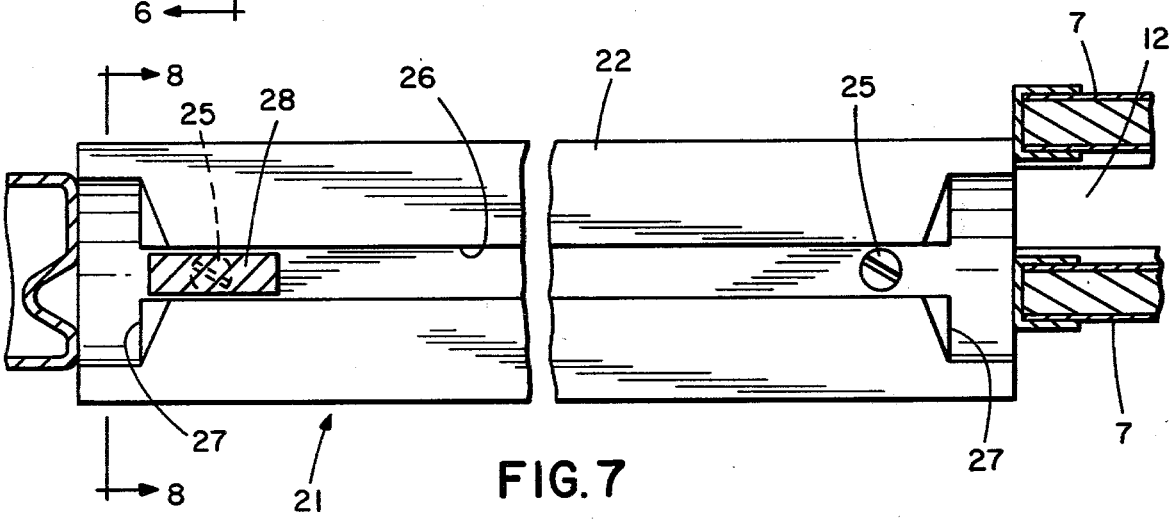
FIG. 7 is a plan cross-sectional view taken generally along line 7—7 in FIG. 5.
Figure 8:
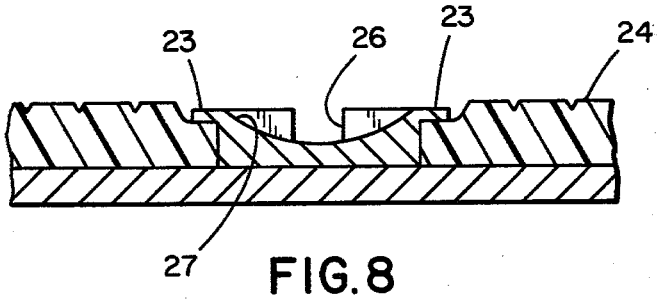
FIG. 8 is a cross-sectional view taken generally along line 8—8 in FIG. 7.

The door 13 is supported on a header channel member 14 suitably connected to the upper ends of the divider walls 7 above the doorway 11 through roller members 15 mounted on the door 13 as illustrated in FIGS. 2 and 3. A deflectable curved leaf-type spring member 16 is positioned within the channel 14 to retard abrupt movement of the roller members 15 and thus of the door 13. The door includes a pair of laterally spaced hollow tubular end members 17 and a panel 18 extending therebetween and connected thereto as shown in FIG. 4 by rivets, screws, bonding or other appropriate means. A window 19 and a door locking or latching arrangement 20 engageable with a keeper or the like (not shown) on the partition wall 6 to secure the door may also be provided in the door as desired, it also being noted that the leading edge of the end member 17 shown in FIG. 4 includes a resilient nose portion cooperative with the edge of the wall 6 to cushion the door as it is moved into the closed position.

As best shown in FIGS. 5–8, a door guide and self-cleaning threshold arrangement 21 is provided to maintain the door in proper transverse alignment as it is moved between its respective open and closed positions, retard abrupt movement of the door, etc. The guide and threshold arrangement includes a threshold plate 22 having transversely extending lip portions 23 overlying and securing the carpeting or similar floor covering material 24 and extending the width of the doorway 11 and into the recess 12 as indicated in FIG. 1 and which is secured to the floor 4 by screws 25. The threshold includes a longitudinal channel or slot 26 extending the length thereof and an arcuate dished-out portion 27 adjacent the partition wall 6 to accommodate cleaning of the channel 26. The door is slidably retained and coupled to the threshold plate 22 through a vertical slide plate 28 secured to the lower end of the door by the slide housing 29. As can be seen from FIGS. 5 and 6, the slide housing is of a capped tubular construction and is secured within the tubular end member 17 by screws 30 or other appropriate fasteners. The slide 28 is mounted within the housing to accommodate vertical movement of the slide. As can be seen from the drawings, an inwardly protruding flange 31 on the housing 29 is engageable with an outwardly protruding nub 32 on the slide to retain it within the housing, and a compression spring 33 is provided between the slide and the cap 34 of the housing to urge the slide against the threshold within the guide channel 26 and thus frictionally retard abrupt movement of the door between its respective open and closed positions due to light car impacts.

Having thus disclosed the invention, it will be apparent that the foregoing description and drawings merely explain and illustrate the invention and that the invention is not limited thereto, except insofar as the appended claims are so limited, as those skilled in the art who have the disclosure before them will be able to make modifications and variations therein without departing from the scope of the invention.

What is claimed is:

1. For a railway passenger car compartment having a floor including an aisle and a pair of longitudinally aligned spaced divider walls adjacent to said aisle and defining an access opening into said compartment, the improvement of a sliding door and door guide arrangement for said opening, comprising:

a door, an elongated threshold plate on the floor and extending the width of the access opening beneath the door and having an upwardly opening longitudinally extending guide channel therein having dished-out end portions extending transversely therefrom at the respective ends of the channel, and guide means depending from the door including biasing means and a vertical guide member, said vertical guide member being downwardly biased by said biasing means and slidably abutably engaged within the guide channel and being positionable generally adjacent a respective dished-out end portion in the open and closed positions of the door to accommodate discharge of foreign matter from the guide channel.

2. The invention according to claim 1, and said guide means including a tubular housing and said vertical guide member being vertically reciprocable therewithin.

3. The invention according to claim 1, and said door having a pair of laterally spaced hollow vertical end members, each end member having front and rear walls and including a first transverse wall connecting said front and rear walls, said front and rear walls projecting inwardly of the door from said first transverse walls to provide opposing vertical recesses in the end members, and a door panel extending into said recesses and between the end members and being secured thereto.

4. The invention according to claim 1, and said guide means including restraint means limiting downward movement of said plate means.

5. The invention according to claim 1, and said threshold plate having transversely extending upper lip portions adapted to overlie and secure floor covering material on said floor.

6. The invention according to claim 1, and a channel member on said divider walls adapted to carry the door spanning the access opening thereabove, and spring means on said channel member engagable with the door to retard abrupt movement thereof.

7. The invention according to claim 1, and said door having a lower edge portion spaced from said threshold plate.

8. The invention according to claim 2, and said biasing means including a compression spring within the housing and reactively interposed between the housing and said plate.

9. The invention according to claim 3, and said guide means being secured within one of said hollow vertical end members.

10. The invention according to claim 3, and said vertical end members being of an integral construction.

* * * * *